US008928713B2

(12) United States Patent
Miyadera et al.

(10) Patent No.: US 8,928,713 B2
(45) **Date of Patent: *Jan. 6, 2015**

(54) OPTICAL WRITING DEVICE HAVING A CORRECTION VALUE INFORMATION GENERATING UNIT, IMAGE FORMING APPARATUS, AND METHOD OF CONTROLLING OPTICAL WRITING DEVICE THEREOF

(75) Inventors: Tatsuya Miyadera, Osaka (JP); Kunihiro Komai, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 343 days.

This patent is subject to a terminal disclaimer.

(21) Appl. No.: 13/372,861

(22) Filed: Feb. 14, 2012

(65) Prior Publication Data

US 2012/0207498 A1 Aug. 16, 2012

(30) Foreign Application Priority Data

Feb. 15, 2011 (JP) ..... 2011-029873

(51) Int. Cl.
*B41J 2/435* (2006.01)
*G03G 15/043* (2006.01)

(52) U.S. Cl.
CPC ..... *G03G 15/043* (2013.01)
USPC ..... 347/229; 399/51

(58) Field of Classification Search
CPC ..... G03G 15/043
USPC ..... 347/12, 229; 399/301, 51
See application file for complete search history.

(56) References Cited

U.S. PATENT DOCUMENTS

| | | | | |
|---|---|---|---|---|
| 2005/0134677 | A1 | 6/2005 | Kawasaki et al. | |
| 2007/0120939 | A1* | 5/2007 | Arai et al. | 347/132 |
| 2008/0193165 | A1 | 8/2008 | Nakazawa et al. | |
| 2011/0085827 | A1* | 4/2011 | Tominaga et al. | 399/301 |
| 2011/0255891 | A1* | 10/2011 | Hirano | 399/51 |
| 2012/0288291 | A1* | 11/2012 | Miyadera | 399/51 |

FOREIGN PATENT DOCUMENTS

| | | |
|---|---|---|
| JP | 07-052447 | 2/1995 |
| JP | 09-323443 | 12/1997 |
| JP | 2005186608 A | 7/2005 |

(Continued)

OTHER PUBLICATIONS

Japanese Office Action dated Oct. 21, 2014 for corresponding Japanese Application No. 2011-029873.

*Primary Examiner* — Laura Martin
*Assistant Examiner* — Carlos A Martinez
(74) *Attorney, Agent, or Firm* — Harness, Dickey & Pierce P.L.C.

(57) ABSTRACT

An optical writing device includes: a photosensitive element whose surface relatively moves with respect to a light source by rotation; a pixel information acquiring unit that acquires pixel information of an image to be formed on the photosensitive element as an electrostatic latent image; a line pixel information storing unit that stores the pixel information for every main scanning line; a light emission control unit that causes a light source to emit light based on the pixel information; a rotation position recognizing unit that recognizes a rotation position of the photosensitive element; and a light quantity control unit that controls a light quantity of the light source based on the pixel information of every one main scanning line in accordance with the rotation position, with reference to correction value information in which the rotation position and information related to a correction of the light quantity are associated.

15 Claims, 12 Drawing Sheets

(56) References Cited

FOREIGN PATENT DOCUMENTS

| | | | |
|---|---|---|---|
| JP | 2006-187929 | A | 7/2006 |
| JP | 2007-144731 | A | 6/2007 |
| JP | 2008-023732 | A | 2/2008 |
| JP | 2008197469 | A | 8/2008 |
| JP | 2010-008913 | A | 1/2010 |

* cited by examiner

DEFAULT STRB TIME: $STRB_{Def}$
MAXIMUM STRB TIME: $STRB_{Max}$
STRB TIME INCREASE DEGREE: $\Delta Y1$
STRB TIME DECREASE DEGREE: $\Delta Y3$ STROBE INCREASE PERIOD: T1
STROBE MAXIMUM PERIOD: T2
STROBE DECREASE PERIOD: T3
STROBE DEFAULT PERIOD: T4

...

| PHASE | STRB TIME |
|---|---|
| E1 | Y1 |
| E2 | Y2 |
| E3 | Y3 |
| E4 | Y4 |
| E5 | Y5 |
| E6 | Y6 |
| E7 | Y7 |
| E8 | Y8 |
| ... | ... |

| PHASE | LINE PERIOD | |
|---|---|---|
| E1 | F1 | |
| E2 | F2 | |
| E3 | F3 | |
| E4 | F4 | ... |
| E5 | F5 | |
| E6 | F6 | |
| E7 | F7 | |
| E8 | F8 | |
| ... | | |

FIG.18

| COUNT VALUE | PHASE | |
|---|---|---|
| 1 | E6 | |
| 2 | E7 | |
| 3 | E8 | |
| 4 | E1 | ... |
| 5 | E2 | |
| 6 | E3 | |
| 7 | E4 | |
| 8 | E5 | |
| | ... | |

FIG.19

| COUNT VALUE | DENSITY | |
|---|---|---|
| 0 | D0 | |
| 1 | D1 | |
| 2 | D2 | |
| 3 | D3 | ... |
| 4 | D4 | |
| 5 | D5 | |
| 6 | D6 | |
| 7 | D7 | |
| | ... | |

FIG.20

| DENSITY |
| --- |
| D0 |
| D1 |
| D2 |
| D3 |
| D4 |
| D5 |
| D6 |
| D7 |
| ... |

FIG.21

| PHASE | DENSITY | |
| --- | --- | --- |
| E6 | D0 | |
| E7 | D1 | |
| E8 | D2 | |
| E1 | D3 | ... |
| E2 | D4 | |
| E3 | D5 | |
| E4 | D6 | |
| E5 | D7 | |
| | ... | |

OPTICAL WRITING DEVICE HAVING A CORRECTION VALUE INFORMATION GENERATING UNIT, IMAGE FORMING APPARATUS, AND METHOD OF CONTROLLING OPTICAL WRITING DEVICE THEREOF

CROSS-REFERENCE TO RELATED APPLICATIONS

The present application claims priority to and incorporates by reference the entire contents of Japanese Patent Application No. 2011-029873 filed in Japan on Feb. 15, 2011.

BACKGROUND OF THE INVENTION

1. Field of the Invention

The present invention relates to an optical writing device, an image forming apparatus, and a method of controlling the optical writing device, and in particular, to correcting degradation in image quality caused by fluctuation in interval between a photosensitive element and a light source.

2. Description of the Related Art

In recent years, there is a tendency to forward the computerization of information, and hence an image processing apparatus such as a printer or a facsimile used to output the computerized information, a scanner used to computerize documents, and the like is becoming an essential apparatus. Such image processing apparatus has an imaging function, an image forming function, a communication function and the like so as to be often configured as a multifunction peripheral (MFP) capable of being used as a printer, a facsimile, a scanner, and a copy machine.

An electrophotography image forming apparatus is being widely used for the image forming apparatus used to output the computerized document in such image processing apparatus. In such electrophotography image forming apparatus, an electrostatic latent image is formed by exposing the photosensitive element, such electrostatic latent image is developed using a developer such as a toner to form a toner image, and such toner image is transferred to a paper to carry out paper output.

In the electrophotography image forming apparatus, an optical writing device for exposing the photosensitive element includes a laser diode (LD) raster optical system type and a light emitting diode (LED) write type. An LED array (LEDA) head is arranged in the case of the LED write type.

In the LED write type optical writing device, the electrostatic latent image is formed by exposing a photosensitive element with the LEDA, as described above, but a spot diameter of a beam emitted from the LEDA and reaching the photosensitive element fluctuates if the distance between the LEDA and the photosensitive element fluctuates, and as a result, a density fluctuation in the image occurs.

For instance, if eccentricity occurs in the photosensitive element, if a film thickness differs according to the site on the surface of the photosensitive element, and the like, the distance between the photosensitive element and the LEDA fluctuates according to the rotation of the photosensitive element, and thus the density fluctuation occurs in a sub-scanning direction in the formed image.

In order to respond to such problem, a technique of maintaining the distance between the photosensitive element and the light source constant has been proposed (see e.g., Japanese Patent Application Laid-open No. 2010-008913, Japanese Patent Application Laid-open No. 2006-187929, and Japanese Patent Application Laid-open No. H7-052447). A technique for correcting the periodic fluctuation by the rotation of the photosensitive element has also been proposed (see e.g., Japanese Patent Application Laid-open No. 2007-144731).

When using the technique disclosed in Japanese Patent Application Laid-open No. 2010-008913, Japanese Patent Application Laid-open No. 2006-187929, and Japanese Patent Application Laid-open No. H7-052447, a component for maintaining the distance between the photosensitive element and the light source constant needs to be arranged, which complicates the component configuration, and increases the device cost and the management cost thus lowering productivity.

When using the technique disclosed in Japanese Patent Application Laid-open No. 2007-144731, the fluctuation in the image quality corresponding to the fluctuation in the relative speed with respect to the light source of the surface of the photosensitive element can be responded as the distance between the photosensitive element and the light source fluctuates.

However, the fluctuation in the image quality corresponding to the fluctuation in the beam spot diameter or the fluctuation in the beam intensity caused by the fluctuation in the distance between the surface of the photosensitive element and the light source cannot be responded by simply adjusting the light emitting cycle of the light source.

Therefore, there is a need for an optical writing device to prevent lowering in image quality caused by the fluctuation in the distance between the photosensitive element and the light source with a simple configuration.

SUMMARY OF THE INVENTION

It is an object of the present invention to at least partially solve the problems in the conventional technology.

According to an embodiment, there is provided an optical writing device that includes: a photosensitive element whose surface relatively moves with respect to a light source by rotation; a pixel information acquiring unit that acquires pixel information which is information of pixels forming an image to be formed on the photosensitive element as an electrostatic latent image; a line pixel information storing unit that stores the acquired pixel information for every main scanning line; a light emission control unit that causes a light source to emit light based on the stored pixel information; a rotation position recognizing unit that recognizes a rotation position of the photosensitive element; and a light quantity control unit that controls a light quantity of when the light emission control unit causes the light source to emit light based on the pixel information of every one main scanning line in accordance with the recognized rotation position, with reference to correction value information in which the rotation position of the photosensitive element and information related to a correction of the light quantity of when causing the light source to emit light are associated.

According to another embodiment, there is provided an image forming apparatus that includes the optical writing device according to the above embodiment.

According to still another embodiment, there is provided a method of controlling an optical writing device for forming an electrostatic latent image on a photosensitive element whose surface relatively moves with respect to a light source by rotation. The method includes: acquiring pixel information, which is information of a pixel configuring an image to be formed as the electrostatic latent image, and storing in a first storage unit; storing the acquired pixel information in a second storage unit for every main scanning line; recognizing a rotation position of the photosensitive element; referencing correction value information in which the rotation position of the photosensitive element and information related to correction of a light quantity of when causing the light source to emit light are associated to each other, and controlling the light quantity of when causing the light source to emit light based on the pixel information of one main scanning line according to the recognized rotation position; and causing the light source to emit light based on the stored pixel information in accordance with the control of the light quantity.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 18 is a view showing an example of information generated in the correction value calculating operation according to the fourth embodiment of the present invention;

FIG. 19 is a view showing an example of information generated in the correction value calculating operation according to the fourth embodiment of the present invention;

FIG. 20 is a view showing an example of information generated in a phase detection operation of a photosensitive element according to a fifth embodiment of the present invention; and FIG. 21 is a view showing an example of a table in which a phase of the photosensitive element and a pattern of density are associated according to the fifth embodiment of the present invention.

DETAILED DESCRIPTION OF THE PREFERRED EMBODIMENTS

Hereinafter, embodiments of the present invention will be described in detail with reference to the drawings. In the embodiments, a multifunction peripheral (MFP) serving as an image forming apparatus will be described by way of example. The image forming apparatus may not be a multifunction peripheral, and may be a copy machine, a printer, a facsimile device, and the like.

First Embodiment

Figure 1:
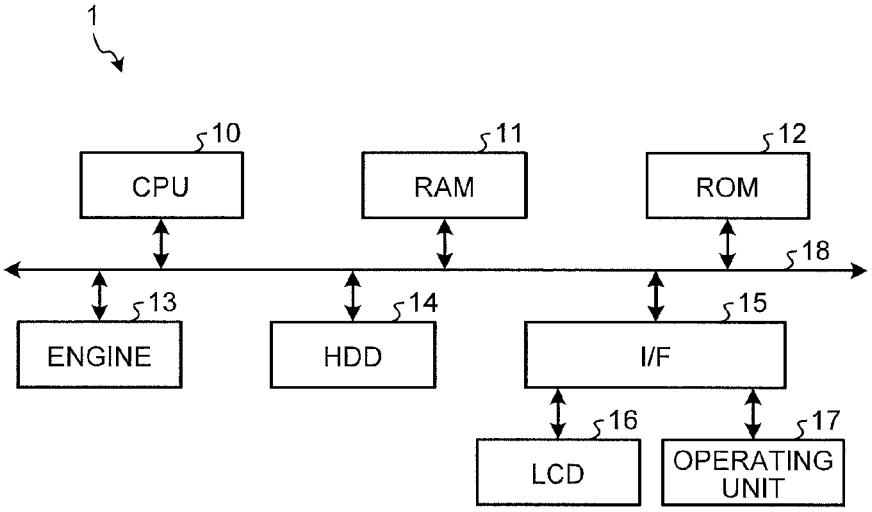
FIG. 1 is a block diagram showing a hardware configuration of an image forming apparatus according to a first embodiment of the present invention.

FIG. 1 is a block diagram showing a hardware configuration of an image forming apparatus 1 according to a first embodiment. As shown in FIG. 1, the image forming apparatus 1 according to the first embodiment includes an engine for executing image forming in addition to the configuration similar to an information processing terminal such as a general server or a personal computer (PC). In other words, the image forming apparatus 1 according to the first embodiment has a central processing unit (CPU) 10, a random access memory (RAM) 11, a read only memory (ROM) 12, an engine 13, a hard disk drive (HDD) 14, and an I/F 15 connected through a bus 18. A liquid crystal display (LCD) 16 and an operating unit 17 are connected to the I/F 15.

The CPU 10 is a calculation means, and controls the operation of the entire image forming apparatus 1. The RAM 11 is a volatile storage medium capable of high speed reading and writing of information, and is used as a work region when the CPU 10 processes information. The ROM 12 is a non-volatile storage medium dedicated for reading, and stores programs such as firmwear. The engine 13 is a mechanism for actually executing image forming in the image forming apparatus 1.

The HDD 14 is a non-volatile storage medium capable of reading and writing information, and stores an operating system (OS), various control programs, applications, programs, and the like. The I/F 15 connects the bus 18 and the various types of hardware and the network, and controls the same. The LCD 16 is a visual user interface for the user to check the state of the image forming apparatus 1. The operating unit 17 is a user interface for the user to input information to the image forming apparatus 1.

In such hardware configuration, the program stored in the ROM 12, the HDD 14, or a recording medium such as an optical disc (not shown) is read to the RAM 11, and the CPU 10 carries out the calculation according to such program to thereby configure a software control unit. The software control unit configured in such manner and the hardware combine to configure a function block that realizes the function of the image forming apparatus 1 according to the first embodiment.

Figure 2:
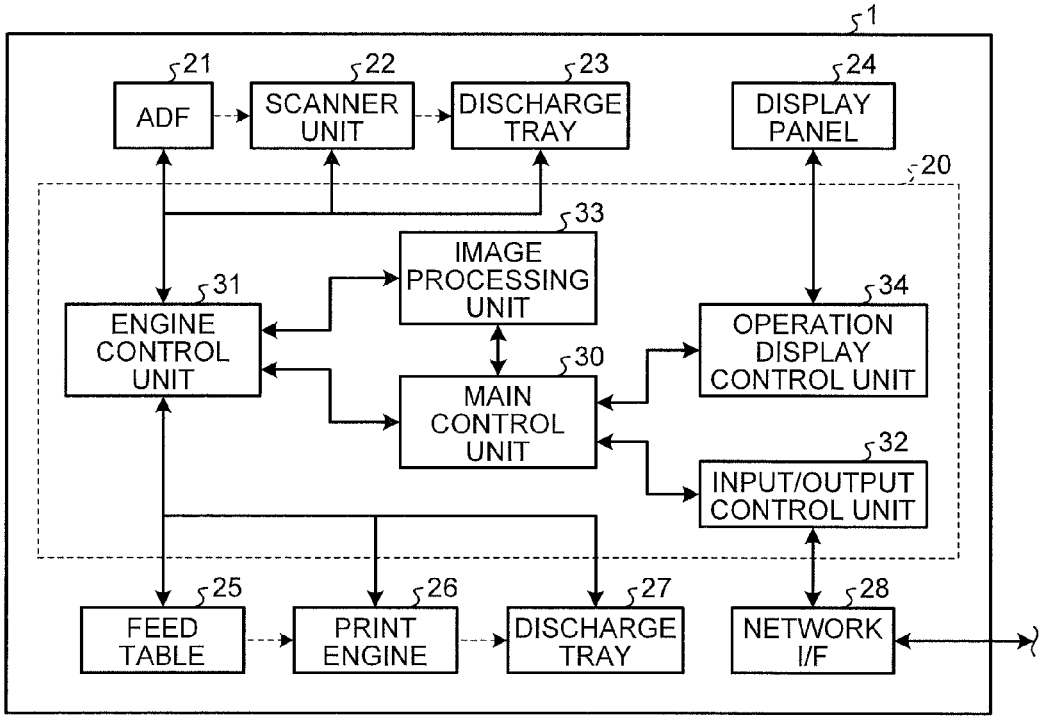
FIG. 2 is a view showing a function configuration of the image forming apparatus according to the first embodiment of the present invention.

The function configuration of the image forming apparatus 1 according to the first embodiment will now be described with reference to FIG. 2. FIG. 2 is a block diagram showing a function configuration of the image forming apparatus 1 according to the first embodiment. As shown in FIG. 2, the image forming apparatus 1 according to the first embodiment includes a controller 20, an auto document feeder (ADF) 21, a scanner unit 22, a discharge tray 23, a display panel 24, a feed table 25, a print engine 26, a discharge tray 27, and a network I/F 28.

The controller 20 includes a main control unit 30, an engine control unit 31, an input/output control unit 32, an image processing unit 33, and an operation display control unit 34. As shown in FIG. 2, the image forming apparatus 1 according to the first embodiment is configured as a multifunction peripheral including the scanner unit 22 and the print engine 26. In FIG. 2, the electrical connection is shown with a solid line arrow, and the flow of paper is shown with a broken line arrow.

The display panel 24 is an output interface for visually displaying the state of the image forming apparatus 1, and is also an input interface (operating unit) of when the user directly operates the image forming apparatus 1 like a touch panel or inputs information to the image forming apparatus 1. The network I/F 28 is an interface for the image forming apparatus 1 to communicate with other devices through the network, and may be the Ethernet (registered trademark) or the USB (Universal Serial Bus) interface.

The controller 20 is configured by combining the software and the hardware. Specifically, the control program such as the firmware stored in a non-volatile recording medium such as the ROM 12, a non-volatile memory, the HDD 14, an optical disc is loaded to volatile memory (hereinafter referred to as memory) such as the RAM 11, where the software control unit configured according to the control of the CPU 10 and the hardware such as an integrated circuit configure the controller 20. The controller 20 serves as a control unit for controlling the entire image forming apparatus 1.

The main control unit 30 has a role of controlling each unit arranged in the controller 20, and gives a command to each unit of the controller 20. The engine control unit 31 serves as a driving unit for controlling or driving the print engine 26, the scanner unit 22, and the like. The input/output control unit 32 inputs signals and commands received through the network I/F 28 to the main control unit 30. The main control unit 30 controls the input/output control unit 32 to access to other devices through the network I/F 28.

The image processing unit 33 generates drawing information based on print information included in the input print job according to the control of the main control unit 30. The drawing information is information for drawing an image to be formed by the print engine 26, which is an image forming unit, at the time of the image forming operation, and is information of a pixel configuring the image to be output, that is, pixel information. The print information included in the print job is image information converted to a format recognizable by the image forming apparatus 1 by the print driver installed in the information processing device such as the PC. The operation display control unit 34 carries out display of information to the display panel 24, or notifies the information input through the display panel 24 to the main control unit 30.

When the image forming apparatus 1 operates as a printer, the input/output control unit 32 first receives the print job through the network I/F 28. The input/output control unit 32 transfers the received print job to the main control unit 30. When receiving the print job, the main control unit 30 controls the image processing unit 33 to generate the drawing information based on the print information contained in the print job.

After the drawing information is generated by the image processing unit 33, the engine control unit 31 executes image forming with respect to a paper conveyed from the feed table 25 based on the generated drawing information. In other words, the print engine 26 serves as the image forming unit. The paper subjected to image formation by the print engine 26 is discharged to the discharge tray 27.

When the image forming apparatus 1 operates as a scanner, the operation display control unit 34 or the input/output control unit 32 transfers a scan execution signal to the main control unit 30 in response to the operation of the display panel 24 by the user or a scan execution instruction input from an external PC or the like through the network I/F 28. The main control unit 30 controls the engine control unit 31 based on the received scan execution signal.

The engine control unit 31 drives the ADF 21 to convey an imaging target document set in the ADF 21 to the scanner unit 22. The engine control unit 31 also drives the scanner unit 22 to image the document conveyed from the ADF 21. If the document is not set in the ADF 21 and the document is directly set in the scanner unit 22, the scanner unit 22 images the set document according to the control of the engine control unit 31. In other words, the scanner unit 22 operates as an imaging unit.

In the imaging operation, the image sensor such as the CCD arranged in the scanner unit 22 optically scans the document, and the imaging information generated based on the optical information is generated. The engine control unit 31 transfers the imaging information generated by the scanner unit 22 to the image processing unit 33. The image processing unit 33 generates image information based on the imaging information received from the engine control unit 31 according to the control of the main control unit 30. The image information generated by the image processing unit 33 is saved in the storage medium attached to the image forming apparatus 1 such as the HDD 14. In other words, the scanner unit 22, the engine control unit 31, and the image processing unit 33 cooperatively operate to function as a document scanning unit.

The image information generated by the image processing unit 33 is stored in the HDD 14 or the like as is, or is transmitted to an external device through the input/output control unit 32 and the network I/F 28 according to the instruction from the user. In other words, the ADF 21 and the engine control unit 31 serve as an image input unit.

When the image forming apparatus 1 operates as the copy machine, the image processing unit 33 generates drawing information based on the imaging information received by the engine control unit 31 from the scanner unit 22 or the image information generated by the image processing unit 33. Similar to the case of the printer operation, the engine control unit 31 drives the print engine 26 based on the drawing information.

Figure 3:
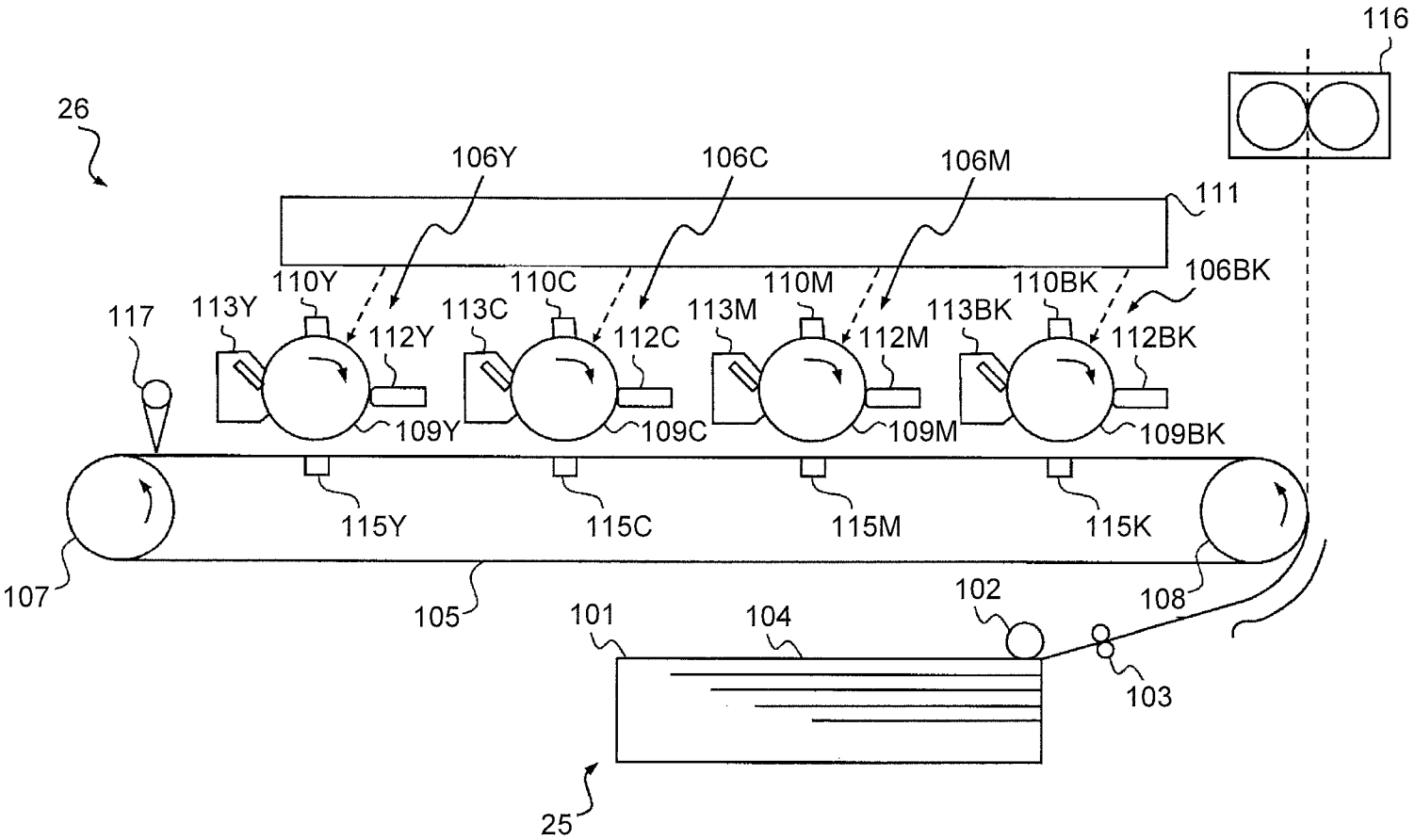
FIG. 3 is a view showing a configuration of a print engine according to the first embodiment of the present invention.

The configuration of the print engine 26 according to the first embodiment will now be described with reference to FIG. 3. As shown in FIG. 3, the print engine 26 according to the first embodiment has a configuration in which an image forming unit 106 of each color is lined along a carriage belt 105, which is an endless movable unit, and is a so-called tandem type. In other words, a plurality of image forming units (electrophotography processing unit) 106BK, 106M, 106C, 106Y are arrayed in order from the upstream side in a conveying direction of the carriage belt 105 along the carriage belt 105, which is an intermediate transfer belt where an intermediate transfer image to be transferred to a paper (one example of recording medium) 104 separated and fed by a paper feeding roller 102 and a separation roller 103 from a paper cassette 101 is formed.

The plurality of image forming units 106BK, 106M, 106C, and 106Y have a common internal configuration and differ only in the color of the toner image to form. The image forming unit 106BK forms a black image, the image forming unit 106M forms a magenta image, the image forming unit 106C forms a cyan image, and the image forming unit 106Y forms a yellow image. In the following description, the image forming unit 106BK will be specifically described, but reference numerals distinguished by M, C, and Y are displayed in the figure in place of the BK denoted on each configuring element of the image forming unit 106BK for each configuring element of the image forming units 106M, 106C, 106Y since the other image forming units 106M, 106C, 106Y are similar to the image forming unit 106BK, and the description thereof will be omitted.

The carriage belt 105 is an endless belt which is bridged between a driving roller 107 to be rotatably driven and a driven roller 108. The driving roller 107 is rotatably driven by a driving motor (not shown), where the driving motor, the driving roller 107, and the driven roller 108 functions as a driving unit for driving the carriage belt 105, which is the endless moving unit.

In image forming, the first image forming unit 106BK transfers a black toner image with respect to the rotatably driven carriage belt 105. The image forming unit 106BK is configured by a photosensitive element 109BK serving as a photosensitive element, a charging unit 110BK, a developing unit 112BK, a photosensitive element cleaner (not shown), a neutralizing unit 113BK, and the like, are arranged at the periphery of the photosensitive element 109BK. The optical writing device 111 is configured to emit light with respect to each photosensitive element 109BK, 109M, 109C, 109Y (hereinafter collectively referred to as "photosensitive element 109").

In image forming, the outer peripheral surface of the photosensitive element 109BK is uniformly charged by the charging unit 110BK in the dark, and then subjected to writing by the light from the light source corresponding to the black image from the optical writing device 111 to thereby form an electrostatic latent image. The developing unit 112BK makes the electrostatic latent image visible with the black toner, so that the black toner image is formed on the photosensitive element 109BK.

The toner image is transferred onto the carriage belt 105 by the action of a transferring unit 115BK at a position (transfer position) where the photosensitive element 109BK and the carriage belt 105 are brought into contact or are the closest. The image by the black toner is formed on the carriage belt 105 by such transfer. The photosensitive element 109BK in which the transfer of the toner image is finished has the unnecessary toner remaining on the outer peripheral surface wiped by the photosensitive element cleaner, and is then neutralized by the neutralizing unit 113BK to wait for the next image formation.

The black toner image transferred onto the carriage belt 105 by the image forming unit 106BK is conveyed to the next image forming unit 106M by the roller driving of the carriage belt 105, as described above. In the image forming unit 106M, a magenta toner image is formed on a photosensitive element 109M through processes similar to the image forming process in the image forming unit 106BK, and such toner image is superimposed and transferred onto the already formed black image.

The black and magenta toner images transferred onto the carriage belt 105 are conveyed to other further image forming units 106C, 106Y, and a cyan toner image formed on a photosensitive element 109C and a yellow toner image formed on a photosensitive element 109Y are superimposed and transferred onto the already transferred images by the similar operation. A full color intermediate transfer image is thereby formed on the carriage belt 105.

A paper 104 accommodated in the paper cassette 101 is sequentially fed from the top, and the intermediate transfer image formed on the carriage belt 105 is transferred to the plane of the paper at a position the feeding path and the carriage belt 105 are brought into contact or the closest. The image is thereby formed on the plane of the paper 104. The paper 104 formed with the image on the plane is further conveyed to fix the image in a fixing unit 116, and is thereafter discharged to the outside of the image forming apparatus.

In such image forming apparatus 1, the toner image of each color may not overlap at the position they are supposed to overlap and a positional deviation may occur among the colors due to the error in inter-axis distance of the photosensitive elements 109BK, 109M, 109C, and 109Y, a parallelism error of the photosensitive elements 109BK, 109M, 109C, and 109Y, an installation error of the light source in the optical writing device 111, a write timing error of the electrostatic latent image to the photosensitive elements 109BK, 109M, 109C, and 109Y, and the like.

For similar reasons, the image may be transferred to a range deviated from the range to which the image is to be transferred in the paper, which is the transferring target. The component of such positional deviation is mainly known to be skew, registration deviation in a sub-scanning direction, magnification error in a main-scanning direction, registration deviation in the main scanning direction, and the like. The error in the rotation speed of the carriage roller for conveying the paper, the error in the conveying amount due to wear, and the like are also known.

A pattern detection sensor 117 is arranged to correct such positional deviation. The pattern detection sensor 117 is an optical sensor for reading a positional deviation correction pattern transferred on the carriage belt 105 by the photosensitive elements 109BK, 109M, 109C, and 109Y, and includes a light emitting element for irradiating a correction pattern drawn on the surface of the carriage belt 105 and a light receiving element for receiving a reflected light from the correction pattern. As shown in FIG. 3, the pattern detection sensor 117 is supported on the same substrate along a direction orthogonal to the conveying direction of the carriage belt 105 on the downstream side of the photosensitive elements 109BK, 109M, 109C, and 109Y.

Figure 4:
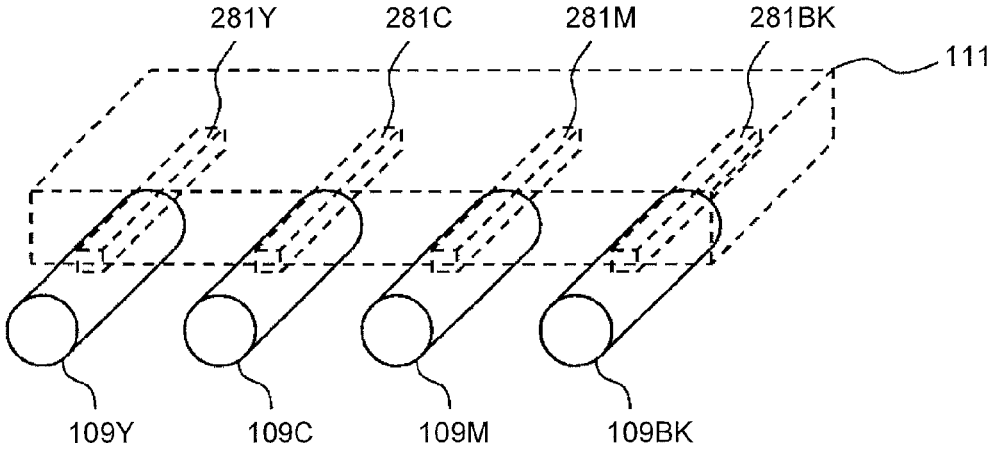
FIG. 4 is a view schematically showing a configuration of an optical writing device according to the first embodiment of the present invention.

An optical writing device 111 according to the first embodiment will now be described. FIG. 4 is a view showing an arrangement relationship of the optical writing device 111 and the photosensitive element 109 according to the first embodiment. As shown in FIG. 4, the irradiation light irradiating the respective photosensitive elements 109BK, 109M, 109C, and 109Y of each color is emitted from LEDAs (LED Array) 281BK, 281M, 281C, and 281Y (hereinafter collectively referred to as LEDA 281), which is a light source.

The LEDA 281 is configured with an LED or a light emitting element lined in the main scanning direction of the photosensitive element 109. A control unit arranged in the optical writing device 111 controls the lighting/non-lighting state of the respective LED lined in the main scanning direction for every main scanning line based on the data of the image to be output to selectively expose the surface of the photosensitive element 109 and form the electrostatic latent image.

Figure 5:
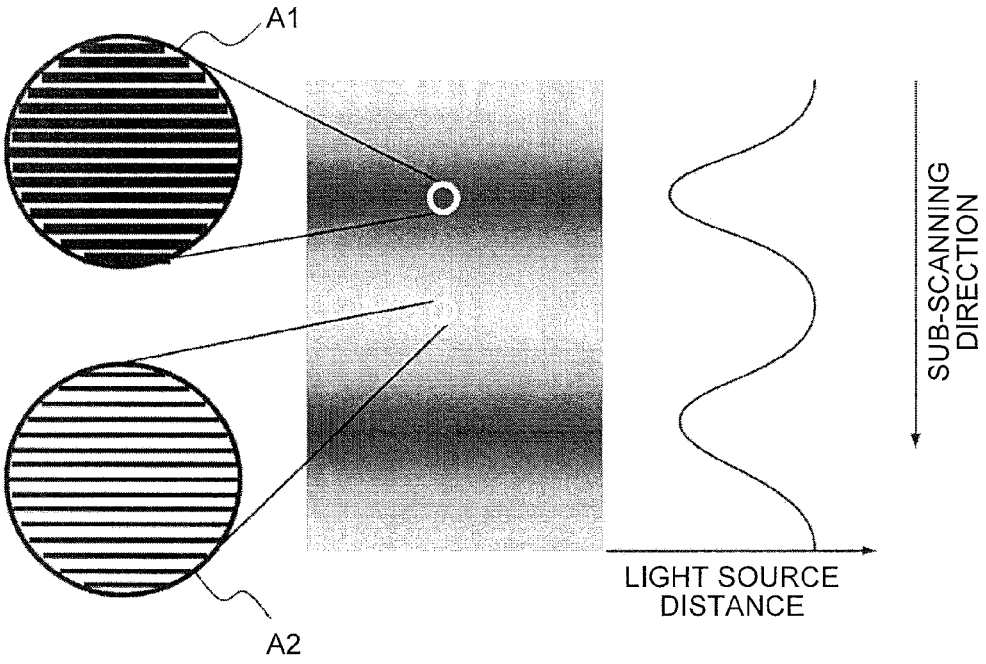
FIG. 5 is a conceptual diagram of a problem to be solved by the optical writing device according to the first embodiment of the present invention.

The problems that arise by the fluctuation in distance between the photosensitive element and the light source as described above will now be described with reference to FIG. 5. FIG. 5 is a view showing an example of an image actually image formed and output and a distance (hereinafter referred to as light source distance) between the light source and the photosensitive element in the sub-scanning direction of such image when the image forming and outputting is executed based on the image data of a band-like image having a uniform density. As shown in FIG. 5, there is a portion of dark color and a portion of light color in the sub-scanning direction.

Generally, the beam emitted from the LEDA 281 becomes a focus on the surface of the photosensitive element 109, and adjustment is made such that the spot diameter of the beam that reached the surface of the photosensitive element 109 becomes constant. However, the distance between the photosensitive element 109 and the LEDA 281 fluctuates according to the rotation of the photosensitive element 109 due to fluctuation in the film thickness of the photosensitive element 109 and the eccentricity of the photosensitive element 109, and thus the spot diameter of the beam that reached the surface of the photosensitive element 109 also fluctuates, and consequently, the image density in the sub-scanning direction fluctuates.

In the example of FIG. 5, a case in which the density becomes higher as the light source distance becomes shorter is described. In other words, the portion of dark color is the portion of short inter-light source distance. If the inter-light source distance is short, the spot diameter of the beam emitted from the LEDA becomes large, and the width in the sub-scanning direction of the image formed for every main scanning line becomes wide, as shown in A1 of FIG. 5, and hence the color consequently becomes dark. The portion of light color is the portion of long inter-light source distance. If the inter-light source distance is long, the spot diameter of the beam emitted from the LEDA becomes small, and the width in the sub-scanning direction of the image formed for every main scanning line becomes narrow, as shown in A2 of FIG. 5, and hence the color consequently becomes light.

When the light source distance becomes long, the intensity of the beam at the surface of the photosensitive element 109 lowers by that much, and thus the exposure intensity of the photosensitive element 109 lowers and the density may become light. In any case, the light source distance fluctuates according to the rotation of the photosensitive element 109, which appears as the fluctuation of the image density in the sub-scanning direction. The first embodiment aims to solve such problem.

Figure 6A:
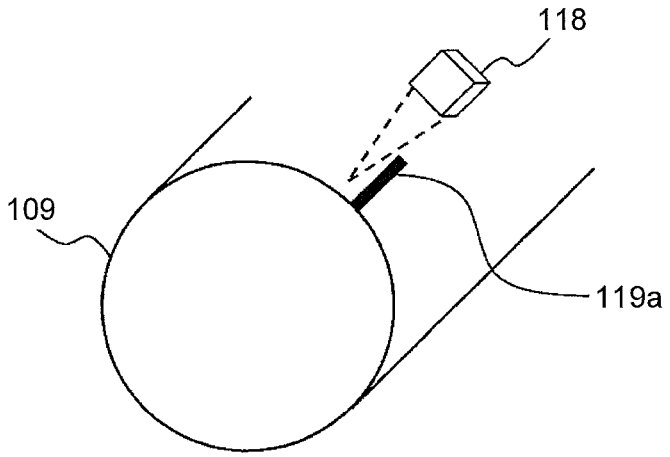
FIG. 6A is a view schematically showing a photosensitive element according to the first embodiment of the present invention.

In order to avoid such problem, in the optical writing device 111 according to the first embodiment, a photosensitive element periodic detection marker 119*a* is arranged at the end in the main scanning direction of the photosensitive element 109 and a phase detection sensor 118 for detecting the photosensitive element periodic detection marker 119*a* is arranged, as shown in FIG. 6A. The summary of the first embodiment is to detect the phase of the rotation of the photosensitive element 109 by the phase detection sensor 118, and control the light emission of the LEDA 281 based on the detection result. The phase detection sensor 118 is arranged to detect a spot same in the sub-scanning direction as the exposure spot by the LEDA 281.

Figures 7, 8:
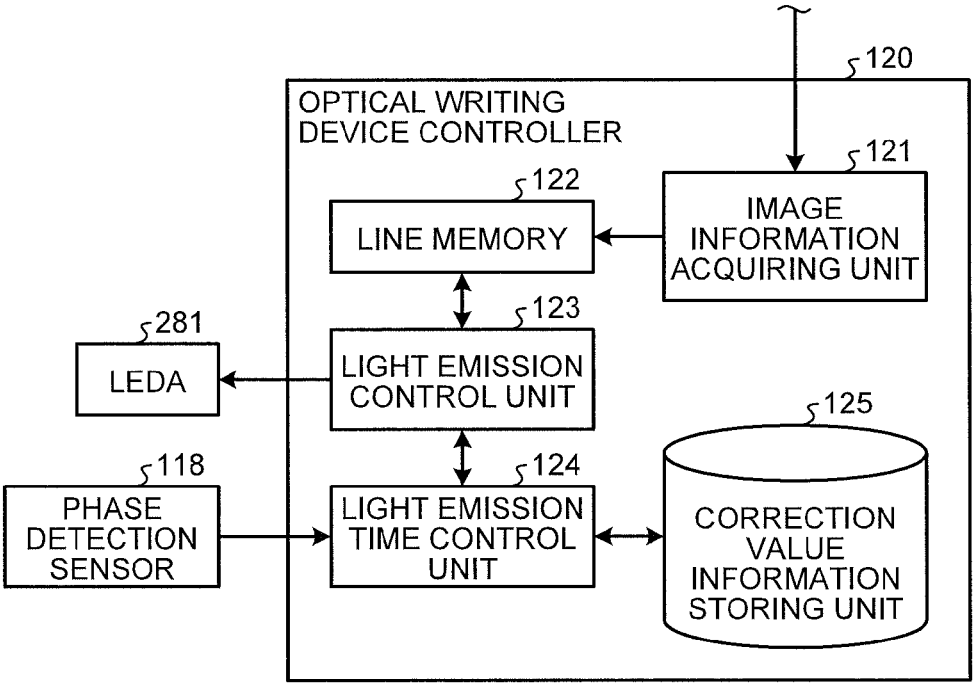
FIG. 7 is a block diagram showing a control unit of the optical writing device according to the first embodiment of the present invention.
FIG. 8 is a view showing an example of correction value information according to the first embodiment of the present invention.

The control block of the optical writing device 111 according to the first embodiment will now be described with reference to FIG. 7. FIG. 7 is a view showing a function configuration of an optical writing device controller 120 for controlling the optical writing device 111 according to the first embodiment and the connecting relationship of the LEDA 281 and the phase detection sensor 118. As shown in FIG. 7, the optical writing device controller 120 according to the first embodiment includes an image information acquiring unit 121, a line memory 122, a light emission control unit 123, a light emission time control unit 124, and a correction value information storing unit 125.

The optical writing device 111 according to the first embodiment includes the CPU 10 as described in FIG. 1 and an information processing mechanism such as a storage medium including the RAM 11 as well as the ROM 12, where the optical writing device controller 120 as shown in FIG. 7 is realized by combining the software control unit configured by loading the control program stored in the storage medium such as the ROM 12 to the RAM 11 and having the CPU 10 carry out the calculation according to the program, and the hardware, similar to the controller 20 of the image forming apparatus 1.

In the following description, the configuration and the function of the optical writing device controller 120 with respect to the LEDA 281 and the phase detection sensor 118 will be described, but the LEDA 281 is arranged in correspondence with each photosensitive element 109BK, 109M, 109C, and 109Y, and the phase detection sensor 118 is arranged for every photosensitive element 109BK, 109M, 109C, and 109Y as described in FIG. 3 and FIG. 4. Therefore, the optical writing device controller 120 has a function of carrying out the control according to the phase detection sensor 118 arranged with respect to the LEDA 281 and the photosensitive element 109 of each color.

The image information acquiring unit 121 acquires the image information (described above as drawing information) input from the controller 20, and stores the information of the pixel configuring the image in the line memory 122 for every main scanning line. In other words, the image information acquiring unit 121 serves as a pixel information acquiring unit, and the line memory 122 serves as a pixel information storing unit.

The light emission control unit 123 is a light source control unit for controlling the light emission of the LEDA 281 based on the pixel information stored in the line memory 122. The light emission control unit 123 reads out the pixel information stored in the line memory 122 for every main scanning line according to a clock in the sub-scanning direction to control the lighting/non-lighting of the LEDA 281. The adjustment of the light quantity in the light emission control of the LEDA 281 of the light emission control unit 123 is one of the summaries according to the first embodiment.

The light emission time control unit 124 has a configuration responsible for the summary according to the first embodiment described above, and adjusts the light quantity of the LEDA 281 by controlling a strobe time (hereinafter referred to as STRB time), which is the light emission time of when the light emission control unit 123 causes the LEDA 281 to emit light. The light emission time control unit 124 executes the adjustment of the light quantity according to the information of a correction value stored in the correction value information storing unit 125 based on a periodic signal input from the phase detection sensor 118. In other words, the light emission time control unit 124 serves as a rotation position recognizing unit for recognizing the phase, that is, the rotation position of the photosensitive element 109, and also serves as a light quantity control unit.

FIG. 8 is a view showing an example of the information of the correction value (hereinafter referred to as correction value information) stored in the correction value information storing unit 125. As shown in FIG. 8, the correction value information according to the first embodiment includes information of $STRB_{Def}$ which indicates the default STRB time in the light emission for every line of the LEDA 281, $STRB_{Max}$ which indicates the maximum STRB time in the adjustment of the STRB time, ΔY1 which indicates an increase value per unit time as a STRB time increase degree of when increasing the STRB time upon adjusting the STRB time, and also ΔY3 which indicates a decrease value per unit time as a STRB time decrease degree of when decreasing the STRB time, T1 which indicates a time to increase the STRB time, T2 which indicates a period to maintain the strobe time to a maximum value, T3 which indicates a period to decrease the strobe time, and T4 which indicates a period to maintain the strobe time at default.

Figures 9, 10:
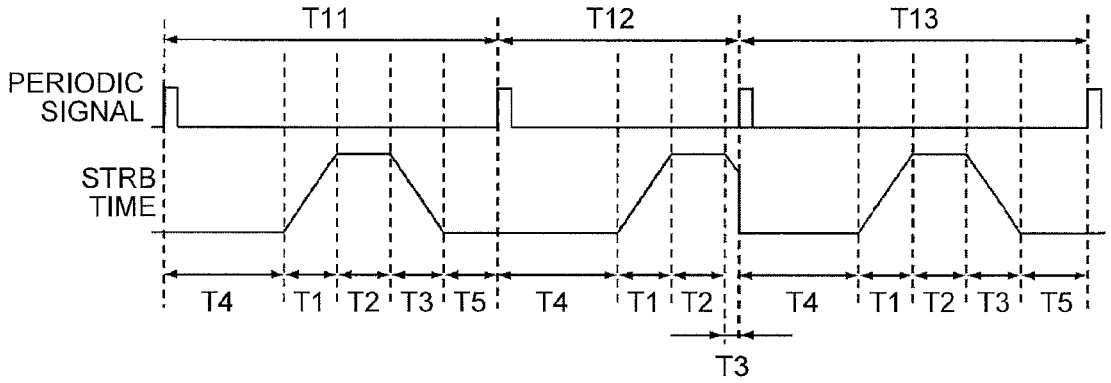
FIG. 9 is a timing chart showing a manner of a light quantity adjustment according to the first embodiment of the present invention.
FIG. 10 is a view showing an example of correction value information according to the second embodiment of the present invention.

The respective information shown in FIG. 8 is set and stored so that the light quantity of the LEDA 281 can be adjusted to prevent degradation in the image quality by the fluctuation based on the fluctuation of the light source distance corresponding to the rotation of the photosensitive element 109. A time series of when the light emission time control unit 124 adjusts the STRB time based on such correction value information will be described with reference to FIG. 9. FIG. 9 is a timing chart showing a periodic signal output when the phase detection sensor 118 detects the photosensitive element periodic detection marker 119*a* according to the rotation of the photosensitive element 109 and a control manner of the STRB time by the light emission time control unit 124.

As shown in FIG. 9, the light emission time control unit 124 outputs a control signal to the light emission control unit 123 to have the STRB time as the $STRB_{Def}$, which is a default value, in accordance with the rise of the periodic signal output from the phase detection sensor 118. Thus, the light emission control unit 123 causes the STRB time of when causing the LEDA 281 to emit light to be $STRB_{Def}$ during the strobe default period T4.

When detecting the periodic signal of the phase detection sensor 118, the light emission time control unit 124 starts counting, resets the counter when the count value reaches a value corresponding to T4, and outputs a control signal to the light emission control unit 123 so as to increase the STRB time at an increase degree of ΔY1 according to the count. The STRB time thereby increases with elapse of time, as shown in FIG. 9.

An example of a value counted by the light emission time control unit 124 may be actual time, number of pulses of a motor adapted to rotate the photosensitive element 109, a rotation detection signal output according to the rotation of the photosensitive element 109, an internal clock in the optical writing device controller 120, and the like. In any case, T1 to T4 shown in FIG. 8 is stored in the correction value information storing unit 125 as information corresponding to the value to be counted.

As described above, the light emission control unit 123 adjusts the STRB time of when causing the LEDA 281 to emit light according to the control signal input from the light emission time control unit 124. Thus, the STRB time of when the light emission control unit 123 causes the LEDA 281 to emit light during the strobe increase period T1 increases at the increase degree of ΔY1 in accordance with elapse of time.

When the count value of the counter reset at the start of the strobe increase period T1 reaches the value corresponding to T1, the light emission time control unit 124 resets the counter and outputs a control signal to the light emission control unit 123 so that the STRB time becomes $STRB_{Max}$, which is a maximum value. The light emission control unit 123 makes the STRB time of when causing the LEDA 281 to emit light to be $STRB_{Max}$ during the strobe maximum period T2.

In the example of FIG. 9, an example in which ΔY1 is set such that the value of the STRB time exactly becomes the value of $STRB_{Max}$ by the elapse of the strobe increase period T1 is described. This is not the sole case, and the STRB time may reach the STRBMax before elapse of T1. In this case, the light emission time control unit 124 outputs a control signal so as not to increase the STRB time to greater than or equal to $STRB_{Max}$ even within the period of T1.

When the count value of the counter reset at the start of the strobe increase period T2 reaches a value corresponding to T2, the light emission time control unit 124 resets the counter and outputs a control signal to the light emission control unit so as to decrease the STRB time at a decrease degree of ΔY3 according to the count. Thus, the STRB time of when the light emission control unit 123 causes the LEDA 281 to emit light during the strobe decrease period T3 decreases at the decrease degree of ΔY3 according to the elapse of time, as shown in FIG. 9.

When the count value of the counter reset at the start of the strobe decrease period T3 reaches a value corresponding to T3, the light emission control unit 124 outputs a control signal to the light emission control unit 123 to have the STRB time at $STRB_{Def}$, which is a default value. Thus, the light emission control unit 123 makes the STRB time of when causing the LEDA 281 to emit light to be $STRB_{Def}$ during T5, which is a period from after elapse of T3 until the next periodic signal is detected.

The adjustment of the STRB time with respect to one rotation of the photosensitive element 109 is completed by the cycle of T4, T1, T2, T3, T5, as shown in the period T11 of FIG. 9. Further describing the period T11, the period T4 and the period T5 are each the period in which the STRB time is default, that is, the minimum STRB time. This period is a period corresponding to the portion in which the image is dark since the light source distance is short, as shown in A2 of FIG. 5.

The period between the period T1 to T3 of FIG. 9 is the period in which the STRB time is increased to reach a maximum value, and thereafter decrease to the default STRB time. This period is the period corresponding to the portion in which the image is light since the light source distance is long, as shown in A1 of FIG. 5. In other words, in the first embodiment, the light quantity is increased by making the STRB time long so that the image does not become light with respect to a range in which the image tends to become light when contrast of image occurs as shown in FIG. 5. A manner of increasing or decreasing the STRB time includes a manner of increasing the STRB time by ΔY1 or decreasing by ΔY3 for every one line of light emission control.

The period T12 shown in FIG. 9 will now be described. The period T12 shown in FIG. 9 shows a time series of when the period of the photosensitive element 109 is fluctuated due to some reason. As shown in FIG. 9, the adjustment of the STRB time is carried out in the periods T4, T1, T2, similar to the period T11.

As shown in FIG. 9, when the periodic signal is detected during the strobe decrease period T3 by the fluctuation in the period of the photosensitive element 109, the light emission time control unit 124 resets the counter and outputs a control signal to the light emission control unit 123 so that the STRB time becomes $STRB_{Def}$, which is a default value, similar to the start of the period T11 and the period T12, and start the period T1.

Thus, the default value, the maximum value, the increase value, and the decrease value of the STRB time may be stored as shown in FIG. 8, and the periods T1 to T4 may be switched and controlled according to the detection of the periodic signal and the subsequent count value, so that the configuration of the optical writing device controller 120 does not become complex even if periodic fluctuation occurs, and the control corresponding to the rotation phase of the photosensitive element 109 can be carried out.

Therefore, as described above, the lowering in image quality due to fluctuation in the distance between the photosensitive element and the light source can be prevented with a simple configuration, according to the optical writing device controller 120 of the first embodiment. Furthermore, according to the method of correcting according to the first embodiment, a correction that can respond to the eccentricity of the photosensitive element 109 such as a trapezoidal correction or a triangular wave correction as shown in FIG. 9 may be realized, but the process in which the set value required for the correction value information is few and can be executed according to such set value is simple, and can be achieved without increasing the processing load of the optical writing device controller 120, as shown in FIG. 8.

In the first embodiment described above, a case in which the default STRB time is a minimum, and the light quantity is adjusted by increase to the maximum value and decrease from the maximum value to the default value, as shown in FIG. 9, has been described by way of example. This is not the sole case, and the default value, the minimum value, and the maximum value may be set, and the adjustment may be carried out including increase and decrease of the minimum value and the default value, and not only the increase and decrease of the maximum value and the default value. The default value may be the maximum value.

Furthermore, the correction pattern during one period of the photosensitive element 109 is not limited to the correction pattern of reciprocating between the minimum value and the maximum value once as shown in FIG. 9, and various correction patterns can be set. For instance, the trapezoidal correction and the triangular wave correction as shown in FIG. 9 may be included in plurals during one period.

In the first embodiment described above, an example of light quantity adjustment by the adjustment of the STRB time has been described. The adjustment of the STRB time is the adjustment of the period of one clock of the line period in which the light emission control unit 123 controls the LEDA 281, that is, the period of causing the LEDA 281 to emit light in the period corresponding to the drawing of the electrostatic latent image for one main scanning line, that is, the proportion of a duty ratio. This is not the sole case, and the light quantity may be adjusted by adjusting the light emission intensity of when the light emission control unit 123 causes the LEDA 281 to emit light.

A control manner of the LEDA 281 includes a manner in which the light emission control unit 123 drives the LEDA 281 at a period of N times, which is an integral multiples of the line period corresponding to the resolution of the pixel information acquired by the image information acquiring unit 121, and reads out the pixel information for one line successively for N times of the pixel information stored in the line memory 122 to make the resolution in the sub-scanning direction to N times. In such a case, the light quantity can be adjusted by increasing or decreasing the number of lines for causing the LEDA 281 to emit light of the N lines corresponding to one main scanning line of the original image.

In the first embodiment described above, an example of adjusting the fluctuation of the image density corresponding to the fluctuation in the sub-scanning direction by adjusting the light quantity according to time series, that is, the rotation of the photosensitive element 109, as shown in FIG. 9, with the fluctuation of the image density in the sub-scanning direction as the target, as shown in FIG. 5 has been described. However, if the film thickness of the photosensitive element 109 is uneven, or the main scanning direction of the LEDA 281 and the main scanning direction of the photosensitive element 109 are tilted, the fluctuation of the image density by the light source distance occurs not only in the sub-scanning direction but also in the main scanning direction.

As a manner corresponding to the fluctuation of the image density in the main scanning direction, the LED element arranged in the LEDA 281 is divided into a plurality of blocks (ranges) in the main scanning direction, T1 to T4 shown in FIG. 8 and FIG. 9 are set for each block, and the light emission control unit 123 controls the LED element arranged in the LEDA 281 for each block.

A general LEDA 281 is configured by lining a plurality of LED chips, which each include a plurality of LED elements and are mounted by being lined in one direction, in the same direction as the arraying direction of the LED elements. Therefore, each of the blocks for dividing the LED elements may have the LED elements of each LED chip.

The absolute values of T1 and T3 shown in FIG. 8 and FIG. 9, and the absolute values of $\Delta Y1$ and $\Delta Y3$ may not necessarily need to be the same. The eccentricity of the photosensitive element 109 by the various manners can be corrected, and an asymmetric correction can also be made.

With respect to the control manner of the optical writing device 111 and the timing to start the image forming and outputting, the optical writing may be started before the periodic signal is detected in the rotation of the photosensitive element 109, that is, the optical writing may be started before the light emission time control unit 124 detects the phase of the photosensitive element 109. In such a case, the optical writing is preferably executed at the STRB time of a minimum value, which is a default STRB time, without carrying out the correction as shown in FIG. 9. According to such control, the image formation can be avoided from being executed at a density too dark.

Second Embodiment

In the first embodiment, a case where the correction value information as shown in FIG. 8 is stored in the correction value information storing unit 125 and the STRB time is adjusted in the manner shown in FIG. 9 has been described by way of example. In a second embodiment, a manner of further adjusting in detail will be described by way of example. The configuration denoted with the reference numerals similar to the first embodiment is assumed to indicate the same or corresponding portions, and the detailed description thereof will be omitted.

FIG. 10 is a view showing an example of the correction value information stored in the correction value information storing unit 125 in the second embodiment. As shown in FIG. 10, the "phase" of the photosensitive element 109 determined based on the detection of the photosensitive element periodic detection marker 119*a* and the "STRB time" in the respective phase are stored in association to each other as the correction value information according to the second embodiment.

In other words, the light emission time control unit 124 according to the second embodiment acquires the information as shown in FIG. 10 from the correction value information storing unit 125, and inputs a control signal for controlling the STRB time of when causing the LEDA 281 to emit light to the light emission control unit 123 according to the periodic signal input from the phase detection sensor 118. In the example of FIG. 10, the phase of "E1" is the phase corresponding to the timing the photosensitive element periodic detection marker 119*a* shown in FIG. 6A is detected.

Figure 11:
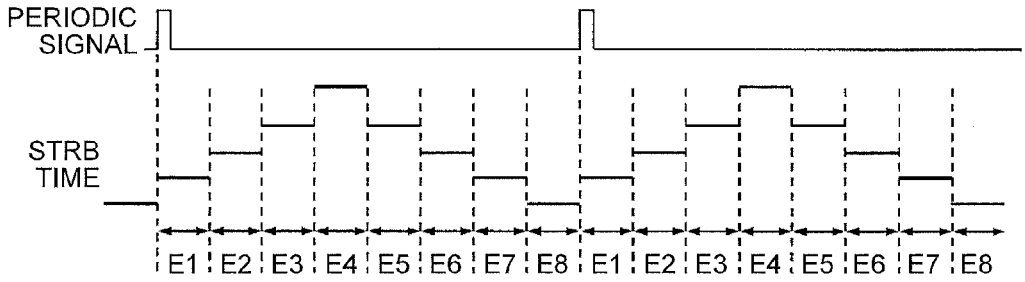
FIG. 11 is a timing chart showing a manner of a light quantity adjustment according to the second embodiment of the present invention.

FIG. 11 is a view showing a time series of the adjustment of the STRB time according to the second embodiment, and is a view corresponding to FIG. 9 of the first embodiment. In FIG. 11 as well, a timing chart showing the periodic signal output when the phase detection sensor 118 detects the photosensitive element periodic detection marker 119*a* according to the rotation of the photosensitive element 109 and the control manner of the STRB time by the light emission time control unit 124 is shown, similar to FIG. 9.

As shown in FIG. 10, the light emission time control unit 124 outputs a control signal specifying the STRB time "Y1" corresponding to the phase "E1" shown in FIG. 10 to the light emission control unit 123 according to the rise of the periodic signal output from the phase detection sensor 118. Thus, the light emission control unit 123 makes the STRB time of when causing the LEDA 281 to emit light to be "Y1" during the period corresponding to the phase "E1".

When detecting the periodic signal of the phase detection sensor 118, the light emission time control unit 124 starts counting, resets the counter when the count value reaches a value corresponding to the each period of "E1", "E2", "E3", . . . shown in FIG. 10, and acquires the STRB time associated with the next phase from the correction value information shown in FIG. 10 to input to the light emission control unit 123 as a control signal.

The light emission control unit 123 controls the STRB time of when the light emission control unit 123 causes the LEDA 281 to emit light according to the "STRB time" defined in the correction value information shown in FIG. 10 over one rotation of the photosensitive element 109 by repeating such operations. According to the manner of FIG. 11, a more specific control of the STRB time than the manner described in FIG. 8 and FIG. 9 can be carried out.

The control with respect to the periodic fluctuation of the photosensitive element 109 described in the first embodiment may be combined with the manner described in FIG. 10 and FIG. 11. In other words, as shown in FIG. 11, the STRB time may be controlled in order from the period of phase "E1" after the detection of the periodic signal, and the light emission time control unit 124 may control the light emission control unit 123 so that the light emission by the STRB time "Y1" corresponding to the phase "E1" is executed according to the detection of the periodic signal if the periodic signal is detected before the end of the phase "E8".

If the control of the phase E8 shown in FIG. 11 is started, the light emission time control unit 124 keeps the STRB time corresponding to the E8 until the next periodic signal is detected. The rapid change in density thus can be avoided, and degradation of the image can be prevented.

Figure 6B:
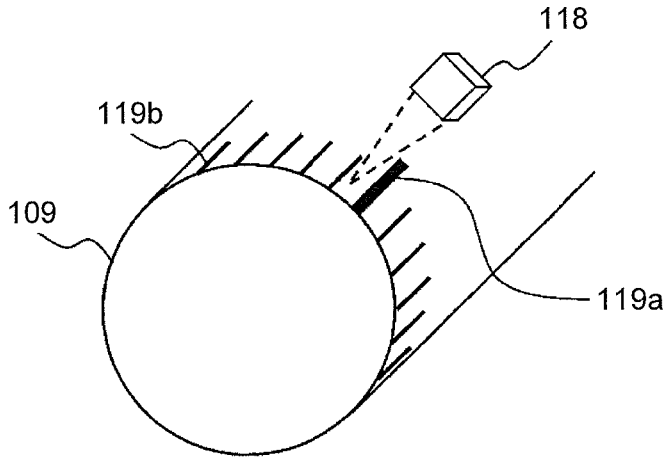
FIG. 6B is a view schematically showing a photosensitive element according to a modification of a second embodiment of the present invention.

As in the example of FIG. 11, instead of determining each phase after the detection of the periodic signal based on the count value, determination may be made by detecting the actual phase of the photosensitive element 109. Such example will be described below. FIG. 6B is a view showing the photosensitive element 109 of when detecting the phase of the photosensitive element 109. In the photosensitive element 109 according to the example of FIG. 6B, a photosensitive element phase detection marker 119*b* is arranged at every predetermined interval in addition to the photosensitive element periodic detection marker 119*a*.

The photosensitive element periodic detection marker 119*a* and the photosensitive element phase detection marker 119*b* have different width in the sub-scanning direction, and thus the time in which the detection signal by the phase detection sensor 118 is in a detected state differs for the time of detection of the photosensitive element periodic detection marker 119*a* and for the time of detection of the photosensitive element phase detection marker 119*b*. The light emission time control unit 124 identifies the photosensitive element periodic detection marker 119*a* and the photosensitive element phase detection marker 119*b* by the difference in the detection signal of the phase detection sensor 118.

Figure 12:
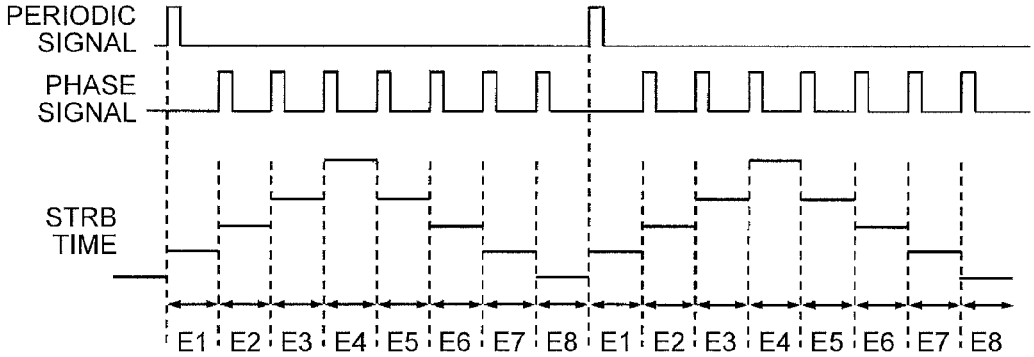
FIG. 12 is a timing chart showing a manner of the light quantity adjustment according to the second embodiment of the present invention.

When using such photosensitive element 109, the light emission time control unit 124 detects the phase signal or the detection signal of the photosensitive element phase detection marker 119*b* in addition to the periodic signal or the detection signal of the photosensitive element periodic detection marker 119*a*. As shown in FIG. 12, the light emission time control unit 124 acquires the STRB time of the next phase from the correction value information shown in FIG. 10 every time the phase signal is detected after starting the control of the phase "E1" by the detection of the periodic signal, and inputs to the light emission control unit 123 as a control signal. The detailed control of the STRB time similar to FIG. 11 thus can be executed based on the actual phase of the photosensitive element 109.

As described above, according to the optical writing device controller 120, the lowering in the image quality due to the fluctuation in the distance between the photosensitive element and the light source can be prevented and a more specific control of the STRB time can be realized according to the phase of the photosensitive element 109 with a simple configuration.

Similar to the first embodiment, the LED elements arranged in the LEDA 281 is divided into a plurality of blocks to correspond to the fluctuation of the image density in the main scanning direction, and the "STRB time" shown in FIG. 10 is set for each block.

In the second embodiment described above, a case on which the STRB time is directly specified in the correction value information is described by way of example, as shown in FIG. 10. Not limited thereto, the information of the correction value with respect to the default STRB time, that is, the difference value may be set according to the phase of the photosensitive element 109. In any case, similar effects can be obtained as long as the correction value information is the information for specifying the light quantity of when the light emission control unit 123 causes the LEDA 281 to emit light according to the phase of the photosensitive element 109, as the information related to the correction of the light quantity.

Third Embodiment

In a third embodiment, the manner of correcting the fluctuation of the image density caused by the fluctuation in the relative speed with respect to the light source of the surface of the photosensitive element 109 due to the fluctuation of the light source distance will be described in addition to the correction of the spot diameter fluctuation by the light source distance and the fluctuation of the image density caused by the exposure intensity fluctuation described in the first and second embodiments.

Figures 13, 14:
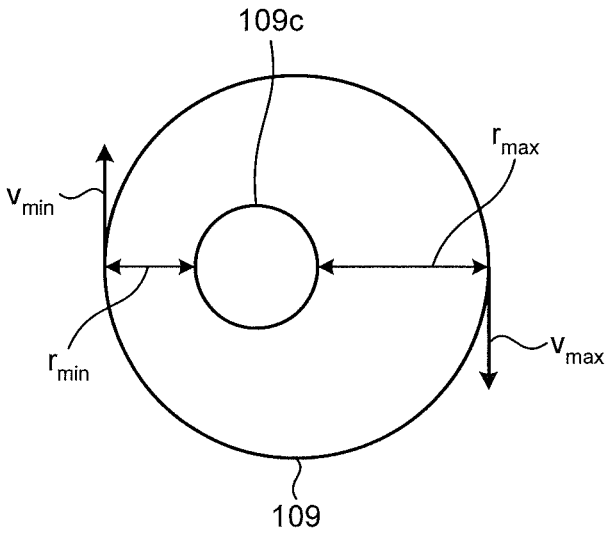
FIG. 13 is a conceptual diagram of a problem to be solved by an optical writing device according to a third embodiment of the present invention.
FIG. 14 is a view showing an example of periodic correction information according to the third embodiment of the present invention.

FIG. 13 is a view for describing the fluctuation of the relative speed with respect to the light source of the surface of the photosensitive element 109 due to the fluctuation of the light source distance, and shows a state in which the photosensitive element 109 is seen in the rotation axis direction. In the example of FIG. 13, the rotation axis of the photosensitive element 109 is shifted to the left side. In this case, $r_{min}$ in which the distance from the rotation axis to the surface of the photosensitive element is a minimum, and $r_{max}$ in which the distance is a maximum are produced. If the distance from the rotation axis differs, a difference such as $v_{mm}$ and $v_{max}$ also are produced in the relative speed (hereinafter referred to as surface speed) with respect to the LEDA 281 of the surface of the photosensitive element if the photosensitive element 109 is rotating at a predetermined angular speed.

When the light emission control unit 123 causes the LEDA 281 to emit light always at a constant line period, the number of light emissions in a predetermined range in the sub-scanning direction of the photosensitive element becomes large and the color becomes darker since the surface speed is slow in the range of the surface speed $v_{min}$. In the range of the surface speed $v_{max}$, on the other hand, the number of light emissions in a predetermined range in the sub-scanning direction of the photosensitive element becomes small and the color becomes lighter since the surface speed is fast. The third embodiment aims to solve such problem.

Therefore, the correction information storing unit 125 according to the third embodiment stores information (hereinafter referred to as periodic correction information) as shown in FIG. 14 for adjusting the line period in accordance with the rotation phase of the photosensitive element 109, in addition to the correction value information as shown in FIG. 8 or FIG. 10. As shown in FIG. 14, in the periodic correction information according to the present embodiment, the "phase" of the photosensitive element 109 and the "line period" in the respective phase are stored in association to each other.

Similar to the process in FIG. 11 or FIG. 12, the light emission time control unit 124 reads out the "line period" from the periodic correction information according to the phase of the photosensitive element 109 based on the periodic correction information, and inputs the same as a control signal to the light emission control unit 123. The light emission control unit 123 adjusts the line period of when controlling the LEDA 281 according to the phase of the photosensitive element 109 and thus can solve the problem described in FIG. 13.

As described above, according to the optical writing control device 120 of the third embodiment, the lowering in the image quality due to the fluctuation in the distance between the photosensitive element and the light source can be prevented, and the lowering in the image quality due to the fluctuation in the surface speed of the photosensitive element 109 can be prevented with a simple configuration.

In the third embodiment described above, a case in which the periodic correction information as shown in FIG. 14 is generated and the line period is corrected with a manner complying with FIG. 11 and FIG. 12 has been described by way of example. In addition, application can be similarly made with a manner of specifying the respective period in addition to the default, the maximum value (maximum value), the increase degree, and the decrease degree, as described in FIG. 8.

Fourth Embodiment

Figure 15:
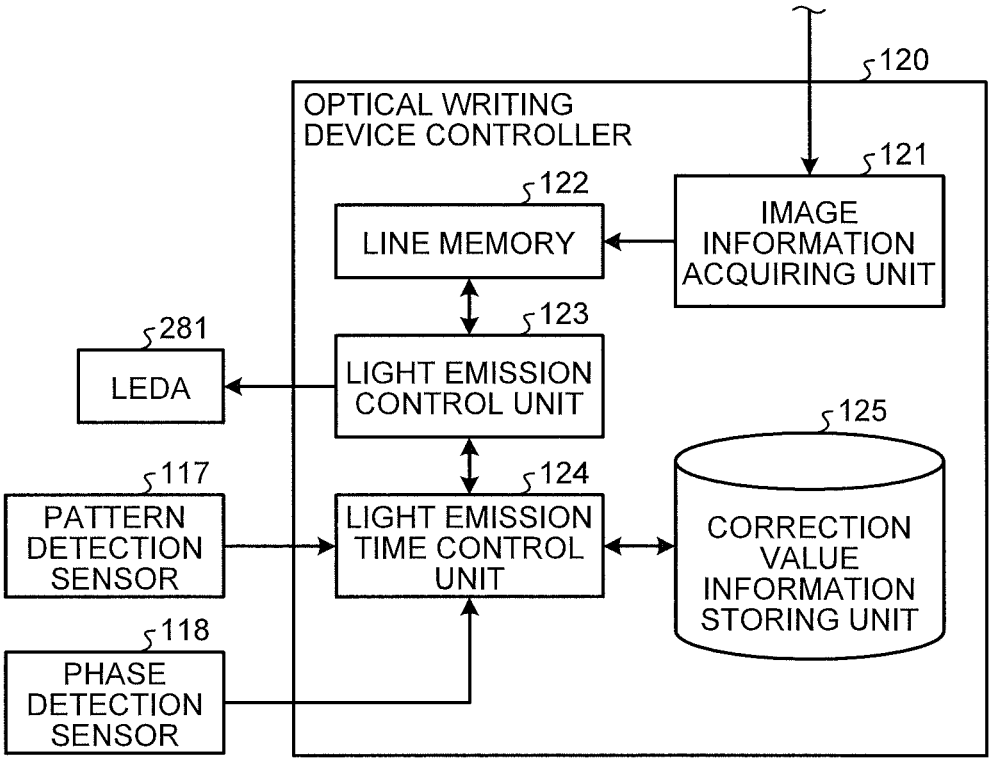
FIG. 15 is a block diagram showing a control unit of an optical writing device according to a fourth embodiment of the present invention.

In a fourth embodiment, a manner of generating the correction value information as shown in FIG. 10, and storing the same in the correction value information storing unit 125 will be described. FIG. 15 is a view showing a function configuration of the optical writing device controller 120 according to the fourth embodiment. As shown in FIG. 15, in the optical writing device controller 120 according to the fourth embodiment, the light emission time control unit 124 is configured to be able to also acquire a detection signal of the pattern detection sensor 117. The light emission time control unit 124 according to the fourth embodiment generates the correction value information as shown in FIG. 10 based on the pattern detection signal input from the pattern detection sensor 117.

Figure 16:
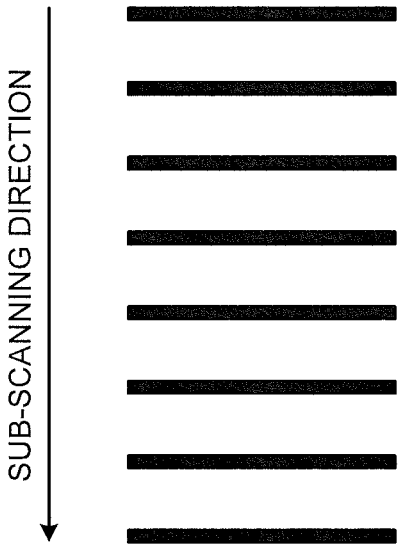
FIG. 16 is a view showing an example of a pattern for correction value calculation according to the fourth embodiment of the present invention.

When generating the correction value information according to the fourth embodiment, the light emission control unit 123 controls the LEDA 281 to draw the pattern as shown in FIG. 16 on the photosensitive element 109. The light emission time control unit 124 generates the correction value information as shown in FIG. 10 on the basis of the detection signal from the pattern detection sensor 117 based on the above pattern, and the periodic signal input from the phase detection sensor 118.

As shown in FIG. 16, the pattern drawn in the generation of the correction value information according to the present embodiment is that pattern in which a band-like line parallel to the main scanning direction is arranged in plurals in the sub-scanning direction. This pattern is arranged at least over one round of the photosensitive element 109. The interval in which the band-like lines are arranged is the interval corresponding to the respective period of "E1", "E2", "E3", . . . shown in FIG. 11 and FIG. 12.

Figure 17:
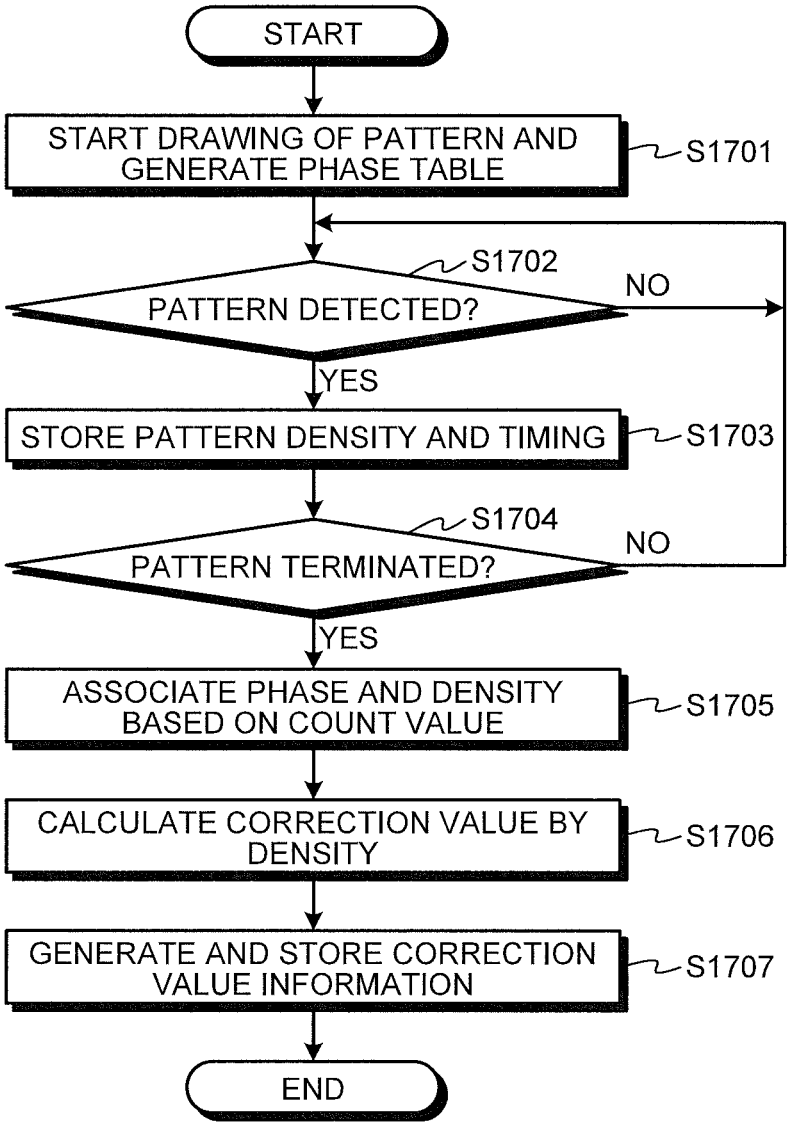
FIG. 17 is a flowchart showing a correction value calculating operation according to the fourth embodiment of the present invention.

FIG. 17 is a flowchart showing an operation of generating the correction value information according to the fourth embodiment. As shown in FIG. 17, the light emission control unit 123 first starts the drawing of the pattern as shown in FIG. 16 (S1701). The light emission control unit 123 controls the LEDA 281 to draw the pattern based on the information of the image for drawing the pattern as shown in FIG. 16 stored in advance.

When the pattern as shown in FIG. 16 is drawn in S1701, the light emission time control unit 124 detects the periodic signal input from the phase detection sensor 118 and starts counting, and enables the phase in one round of the photosensitive element 109 to be determined based on the count value. Every time the light emission control unit 123 causes the LEDA 281 to emit light to draw the band-line line shown in FIG. 16, the phase of the photosensitive element 109 is recognized by the above manner, and the light emission count value of the LEDA 281 and the phase of the photosensitive element 109 are stored in association to each other. A phase table as shown in FIG. 18 is thereby generated.

When the pattern is drawn on the photosensitive element 109, and such pattern is transferred to the carriage belt 105 to be conveyed, the pattern detection sensor 117 detects such pattern. When acquiring the detection signal from the pattern detection sensor (S1702, YES), the light emission control unit 124 stores information in which the count value of the number of times the pattern is detected and the density of the pattern detected by the pattern detection sensor 117 are associated (S1703).

The light emission time control unit 124 repeats the processes of S1702, S1703 until all the patterns shown in FIG. 16 are detected (S1704, NO). The information shown in FIG. 19 is thus stored. FIG. 19 shows information in which the count value of the number of times the pattern is detected and the density of the pattern detected by the pattern detection sensor 117 are associated. The information shown in FIG. 18 and FIG. 19 may be temporarily stored in the correction value information storing unit 125, or may be held in the non-volatile storage medium such as the RAM.

When all the patterns are detected (S1704, YES), the light emission time control unit 124 corresponds to the count value shown in FIG. 18 and the count value shown in FIG. 19, and associates the "phase" and the "density" associated with the same count value (S1705). For instance, in the case of the example of FIG. 18 and FIG. 19, the density "D0" and the phase "E6" are associated.

After the association of the phase and the density is completed, the light emission time control unit 124 calculates the correction value for correcting the density to an appropriate value based on the information of the density (S1706). The correction value calculated in S1706 corresponds to the "STRB time" shown in FIG. 10. In other words, in S1706, the light emission time control unit 124 calculates the STRB time for appropriately correcting the density of the pattern detected by the pattern detection sensor 117. The correction value information in which the phase and the STRB time are associated, as shown in FIG. 10, is thereby generated.

After the correction value information is generated, the light emission time control unit 124 stores the generated correction value information in the correction value information storing unit 125 (S1707), and terminates the process. According to such process, the correction value information as shown in FIG. 10 is stored in the correction value information storing unit 125. The processes of S1705 and S1706 may be interchanged. In other words, the density shown in FIG. 19 may be converted to a correction value, and then the phase and the correction value may be associated based on the count value.

Therefore, in the fourth embodiment, the correction value information is automatically generated based on the information of the pattern shown in FIG. 16 stored in advance, the detection result of the pattern by the pattern detection sensor 117, and the detection result of the phase of the photosensitive element 109 by the phase detection sensor 118. Thus, the operator does not need to manually set the correction value, and the management load of the device can be alleviated. Furthermore, change over time of the photosensitive element 109 can also be responded by periodically executing the calculation of such correction value. As the correction value is calculated with the photosensitive element 109 and the LEDA 281 actually assembled and operated, a more accurate correction value can be calculated.

In the fourth embodiment described above, an example of a response complying with FIG. 6A and FIG. 11, that is, a manner of determining the phase of the photosensitive element 109 by the detection of the periodic signal and the count value has been described by way of example. This is not the sole case, and application can be similarly made for the response complying with FIG. 6B and FIG. 12.

Similar to the first and second embodiments, in order to respond to the fluctuation in the image density in the main scanning direction, the LED elements arranged in the LEDA 281 is divided into a plurality of blocks, the pattern detection sensor 117 is arranged in plurals in the main scanning direction to respond to the respective block, and the STRB time is calculated based on the density detected for each pattern detection sensor.

Fifth Embodiment

In a fifth embodiment, a manner different from FIGS. 6A, 6B will be described as a manner of phase detection of the photosensitive element 109. In the manner of the phase detection of the photosensitive element shown in FIGS. 6A, (6B, the productivity of the photosensitive element 109 is influenced since a pattern needs to be provided on the photosensitive element 109. The detection of the pattern may become difficult due to change over time of the photosensitive element 109.

In the fifth embodiment, on the other hand, the light emission control unit 123 controls the LEDA 281, and forms a pattern similar to the photosensitive element periodic detection marker 119*a* and the photosensitive element phase detection marker 119*b* in a range not used in the normal image forming and outputting such as the end in the main scanning direction of the photosensitive element 109 shown in FIGS. 6A, 6B. In this case, the light emission control unit 123 forms all patterns by causing the LEDA 281 to emit light at the same STRB time.

The light emission time control unit 124 generates information of the density of each marker, as shown in FIG. 20 by reading the pattern with the pattern detection sensor 117 or the phase detection sensor 118. In the example of FIG. 20, the pattern of the density "D0" is the detection density of the pattern corresponding to the photosensitive element periodic detection marker 119*a*, that is, the pattern having a wider width in the sub-scanning direction than other patterns.

The light emission time control unit 124 carries out pattern matching of a row of density shown in FIG. 20 and a row of density shown in FIG. 21 based on a table in which the phase of the photosensitive element 109 and the density of the pattern formed when the optical writing is carried out at the same STRB time are associated, as shown in FIG. 21. The table shown in FIG. 21 is stored, for example, in the correction value information storing unit 125.

The light emission time control unit 124 extracts a phase associated with the pattern corresponding to the photosensitive element periodic detection marker 119*a* based on the above pattern matching. In the example of FIG. 21, the phase "E6" is extracted. The phase "E6" is recognized by the light emission time control unit 124 as the phase of the range in which the photosensitive element periodic detection marker 119*a* is formed in the photosensitive element 109.

Therefore, when carrying out the correction of the light quantity as described in the second embodiment, for example, in the subsequent control, the light emission time control unit 124 reads out the STRB time corresponding to the phase "E6" to control the light emission control unit 123 when detecting the periodic signal as shown in FIG. 11. Thereafter, the control for one round of the photosensitive element 109 such as "E7", "E8", . . . is carried out.

According to such configuration and control, the control described in the first to fourth embodiments can be executed even if the photosensitive element periodic detection marker 119*a* and the photosensitive element phase detection marker 119*b* are not formed in advance on the photosensitive element 109. Furthermore, the photosensitive element periodic detection marker 119*a* and the photosensitive element phase detection marker 119*b* are always newly formed by applying the present embodiment, so that reading can be avoided from becoming difficult due to degradation over time of the photosensitive element 109.

According to the embodiments, the lowering in image quality caused by the fluctuation in the distance between the photosensitive element and the light source can be prevented with a simple configuration.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An optical writing device comprising:

a photosensitive element whose surface relatively moves with respect to a light source by rotation;

a pixel information acquiring unit that acquires pixel information which is information of pixels forming an image to be formed on the photosensitive element as an electrostatic latent image;

a line pixel information storing unit that stores the acquired pixel information for every main scanning line;

a light emission control unit that causes a light source to emit light based on the stored pixel information;

a rotation position recognizing unit that recognizes a rotation position of the photosensitive element; and a light quantity control unit that controls a light quantity of when the light emission control unit causes the light source to emit light based on the pixel information of every one main scanning line in accordance with the recognized rotation position, with reference to correction value information in which the rotation position of the photosensitive element and information related to a correction of the light quantity of when causing the light source to emit light are associated, wherein the light emission control unit forms a plurality of lines parallel to the main scanning direction at a set interval over one period of the photosensitive element for a pattern, by controlling the light source, and wherein the optical writing device further includes:

a pattern reading unit that reads the pattern; and a correction value information generating unit that generates the correction value information based on the reading result of the pattern and the recognition result of the rotation position of the photosensitive element recognized by the rotation position recognizing unit, and stores a number of formations of the line and the rotation position of the photosensitive element recognized by the rotation position recognizing unit in association to each other every time the light emission control unit forms the line.

2. The optical writing device according to claim 1, wherein the correction value information includes information of an increase degree of when increasing the light quantity, a maximum value of the light quantity, a decrease degree of when decreasing the light quantity, a period of increasing the light quantity, a period of maintaining the light quantity at a maximum value, and a period of decreasing the light quantity, and wherein the light quantity control unit determines one of the period of increasing the light quantity, the period of maintaining the light quantity at the maximum value, and the period of decreasing the light quantity in accordance with the recognized rotation position, and controls the light quantity based on the information of the increase degree of when increasing the light quantity, the maximum value of the light quantity, and the decrease degree of when decreasing the light quantity in accordance with the determination result.

3. The optical writing device according to claim 2, wherein the light emission control unit increases or decreases the light quantity of when the light emission control unit causes the light source to emit light for every one main scanning line according to the control of the light quantity control unit in the period of increasing the light quantity and the period of decreasing the light quantity.

4. The optical writing device according to claim 2, wherein the period of increasing the light quantity, the period of maintaining the light quantity at the maximum value, and the period of decreasing the light quantity are information in a rotation period of the photosensitive element are set; and the light quantity control unit carries out a control corresponding to the setting of the period of increasing the light quantity, the period of maintaining the light quantity at the maximum value, and the period of decreasing the light quantity every time the rotation position recognizing unit recognizes the period of the photosensitive element.

5. The optical writing device according to claim 1, wherein the correction value information is information in which the rotation position of the photosensitive element and information for specifying the light quantity are associated; and the light quantity control unit controls the light quantity based on the information for specifying the light quantity associated with the recognized rotation position.

6. The optical writing device according to claim 5, wherein the correction value information is information in which the rotation position in the rotation of the photosensitive element and a difference amount for correcting the light quantity are associated; and the light quantity control unit controls the light quantity based on the difference amount associated with the recognized rotation position.

7. The optical writing device according to claim 5, wherein the correction value information is information in which a plurality of ranges into which a range of the photosensitive element is divided in the rotating direction and pieces of information for specifying the light quantity are associated, respectively; and the light quantity control unit executes the control of the light quantity for the respective ranges in which the rotation position recognizing unit recognizes the period of the photosensitive element, and then controls the light quantity based on a piece of information for specifying the light quantity associated with a last range of the plurality of ranges until the rotation position recognizing unit recognizes a start of a next period of the photosensitive element.

8. The optical writing device according to claim 1, wherein the photosensitive element includes a periodic detection marker which is arranged thereon to detect the period of the photosensitive element, and wherein the rotation position recognizing unit recognizes the period of the photosensitive element by detecting the periodic detection marker, and recognizes the rotation position of the photosensitive element based on a count value of count starting according to the recognition of the period of the photosensitive element.

9. The optical writing according to claim 1, wherein the photosensitive element includes a periodic detection marker which is arranged thereon to detect the period of the photosensitive element and a rotation position detection marker which is arranged thereon at a set interval in a sub-scanning direction of the photosensitive element to detect the rotation position of the photosensitive element, and wherein the rotation position recognizing unit recognizes the period of the photosensitive element by detecting the periodic detection marker, and recognizes the rotation position of the photosensitive element by detecting the rotation position detection marker.

10. The optical writing device according to claim 9, wherein the periodic detection marker and the rotation position detection marker have different width in the sub-scanning direction, and wherein the rotation position recognizing unit identifies the periodic detection marker and the rotation position detection marker from a difference in a detection signal generated by the difference in the width in the sub-scanning direction of the periodic detection marker and the rotation position detection marker.

11. The optical writing device according to claim 1, wherein the light emission control unit forms a pattern over one period of the photosensitive element by controlling the light source, and wherein the rotation position recognizing unit recognizes the rotation position of the photosensitive element based on a fluctuation in a density of the pattern in a reading result of the pattern with reference to information in which a density fluctuation corresponding to the rotation position for one period of the photosensitive element is stored in advance.

12. The optical writing device according to claim 1, wherein the correction value information is information in which rotation positions of the photosensitive element and pieces of information related to correction of a light quantity for respective ranges into which the light source is divided in the main scanning direction are associated, respectively, and wherein the light quantity control unit controls the light quantity for each of the ranges of the light source.

13. The optical writing device according to claim 1, wherein the correction value information generating unit further, stores number of reading of the line and a density of the line in the reading result of the line in association to each other every time the pattern reading unit reads the line, associates the rotation position of the photosensitive element associated with the number of formations of the line and the density of the line associated with the number of reading of the line by corresponding the number of formations of the line and the number of reading of the line, and generates the correction value information by converting the density to information related to correction of the light quantity by calculating information related to the correction of the light quantity based on the density of the line.

14. An image forming apparatus comprising the optical writing device according to claim 1.

15. A method of controlling an optical writing device for forming an electrostatic latent image on a photosensitive element whose surface relatively moves with respect to a light source by rotation, the method comprising:

acquiring pixel information, which is information of a pixel configuring an image to be formed as the electrostatic latent image, and storing in a first storage unit;

storing the acquired pixel information in a second storage unit for every main scanning line;

recognizing a rotation position of the photosensitive element;

referencing correction value information in which the rotation position of the photosensitive element and information related to correction of a light quantity of when causing the light source to emit light are associated to each other, and controlling the light quantity of when causing the light source to emit light based on the pixel information of one main scanning line according to the recognized rotation position;

causing the light source to emit light based on the stored pixel information in accordance with the control of the light quantity;

forming a plurality of lines parallel to a main scanning direction at a set interval over one period of the photosensitive element for a pattern, by controlling the light source;

reading the pattern;

generating the correction value information based on the reading result of the pattern and the recognition result of the rotation position of the photosensitive element according to the recognized rotation position;

storing a number of formations of the line and the rotation position of the photosensitive element recognized by the recognized rotation position in association to each other every time a light emission control unit forms the line.

* * * * *